US005097866A

United States Patent [19]

Shapiro-Baruch et al.

[11] Patent Number: 5,097,866

[45] Date of Patent: Mar. 24, 1992

[54] REFRIGERANT METERING DEVICE

[75] Inventors: Ian M. Shapiro-Baruch, Syracuse; Wayne B. Cavanaugh, Kirkville; Robert H. Swleczkowski, Cazenovia, all of N.Y.

[73] Assignee: Carrier Corporation, Syracuse, N.Y.

[21] Appl. No.: 559,769

[22] Filed: Jul. 30, 1990

[51] Int. Cl.[5] ..... F25B 41/06

[52] U.S. Cl. ..... 137/544; 137/550; 62/511; 138/41

[58] Field of Search ..... 62/511; 138/40, 41; 137/550, 544

[56] References Cited

U.S. PATENT DOCUMENTS

| | | | |
|---|---|---|---|
| 2,448,315 | 8/1948 | Kunzog | 62/511 |
| 2,576,610 | 11/1951 | Kunzog | 138/41 |
| 2,676,470 | 4/1954 | Streitz | 62/511 |
| 3,270,756 | 9/1966 | Dryden | 137/13 |
| 3,572,390 | 3/1971 | McMichael | 138/41 |
| 3,808,830 | 5/1974 | Atkinson et al. | 62/511 |

*Primary Examiner*—A. Michael Chambers

[57] ABSTRACT

A refrigerant metering device for a vapor compression refrigeration system. The metering device employs a restrictor fabricated of a porous material to achieve the desired pressure reduction across the device. The porous material is housed in a casing that provides support for the restrictor and enables installation of the device into the system. Any suitable porous material may be used to make the restrictor, but in the preferred embodiments, a porous polyethylene material is used. In the preferred embodiments, a filter is provided upstream in the refrigerant flow path to reduce the possibility of restrictor fouling and resultant system performance degradation. In one embodiment, the filter and restrictor are combined as two sections of an integral filter and restrictor. The device is effective in reducing refrigerant flow noise during both steady state operation and post shutdown transients.

1 Claim, 1 Drawing Sheet

REFRIGERANT METERING DEVICE

BACKGROUND OF THE INVENTION

This invention relates generally to devices for metering the flow of refrigerant in a vapor compression refrigeration system. More particularly, the invention relates to a metering device that is effective in reducing refrigerant flow noise during both steady state operation and after shutdown of the refrigeration system in which the device is installed.

One of the essential components of a closed cycle vapor compression refrigeration system is a metering or expansion means for effecting a drop in the refrigerant pressure at one point in the cycle, thus causing a change of refrigerant state from liquid to gas and a reduction in refrigerant pressure and temperature due to adiabatic expansion. Many types of such metering devices are known in the art, including thermoexpansion valves, Accurator®, orifices and capillary tubes. Capillary tubes, because of their relatively small size and low cost, are commonly found in small to medium capacity refrigeration systems such as room air conditioners and packaged terminal air conditioners.

An objective in the design and manufacture of a refrigeration system, particularly one that is intended to operate in or near inhabited areas, is to reduce the sound radiated by the system, not only during operation but also during post shutdown transients. One source of sound in a refrigeration system is the metering device. High velocity liquid refrigerant passing through a capillary tube metering device during system operation can be a source of objectionable noise. The passage of high velocity gaseous refrigerant through a capillary tube metering device during system shutdown can also radiate noise of a different but still objectionable nature.

What is needed therefore, is a metering device that reduces the radiated noise level of a vapor compression refrigeration system.

SUMMARY OF THE INVENTION

The objects of the present invention are to provide a low cost refrigerant metering device for a vapor compression refrigeration system that offers performance comparable to a capillary tube but produces less noise during both system operation and shutdown transients.

The present invention achieves these objects in a refrigerant metering device that employs a restrictor fabricated of a porous material to achieve the desired pressure reduction across the device. The porous material is housed in a casing that provides support for the restrictor and enables installation of the device into a refrigeration system. Any suitable porous material may be used to make the restrictor, but in the preferred embodiments, a porous polyethylene material is used. In the preferred embodiments, a filter is provided upstream in the refrigerant flow path from the restrictor to reduce the possibility of restrictor fouling and resultant system performance degradation. The device thus serves to provide metering, filtration and sound attenuation functions all in one. In one preferred embodiment, the filter and restrictor are combined as two sections of an integral filter and restrictor.

The device of the present invention is capable for use as a metering device in any application in which a capillary tube would be commonly used but is particularly suitable for use in applications where noise reduction is a significant performance goal, such as in room air conditioners and packaged terminal air conditioning systems.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
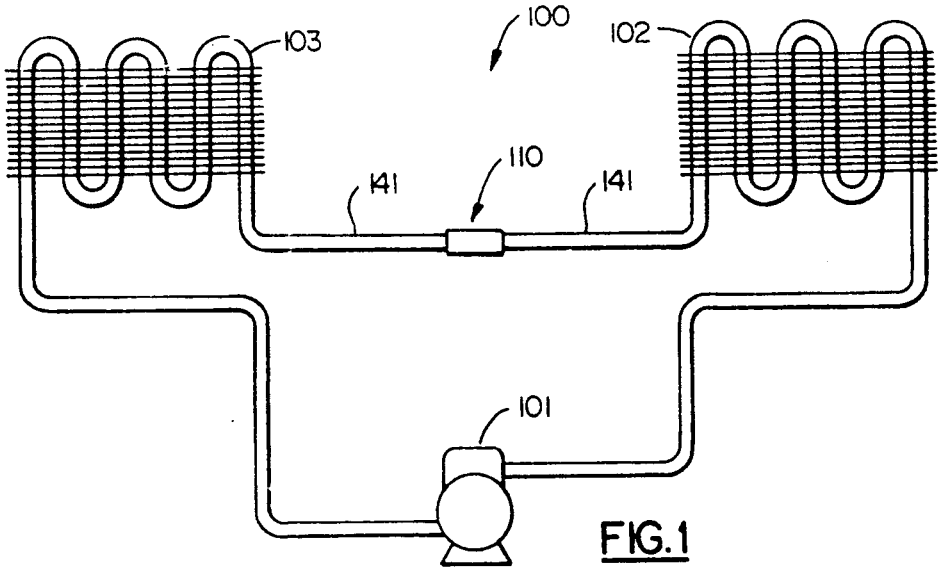
FIG. 1 is a schematic diagram of a typical vapor compression refrigeration system in which the present invention is used.

FIG. 1 is a schematic diagram of a typical closed cycle vapor compression refrigeration system 100. System 100 comprises compressor 101, condenser 102, metering device 110 and evaporator 103 interconnected in a closed circuit by piping or tubing. Feeder tubes 141 connect condenser 102 with metering device 110 and metering device 110 with evaporator 103. Refrigerant flows through system 100 from the discharge of compressor 101 to and through condenser 102, then through metering device 110, where it undergoes a pressure reduction, phase change from a liquid to a gas and a reduction in temperature due to adiabatic expansion. From metering device 110, the refrigerant then flows through evaporator 103 before returning to the suction of compressor 101.

Figure 2:
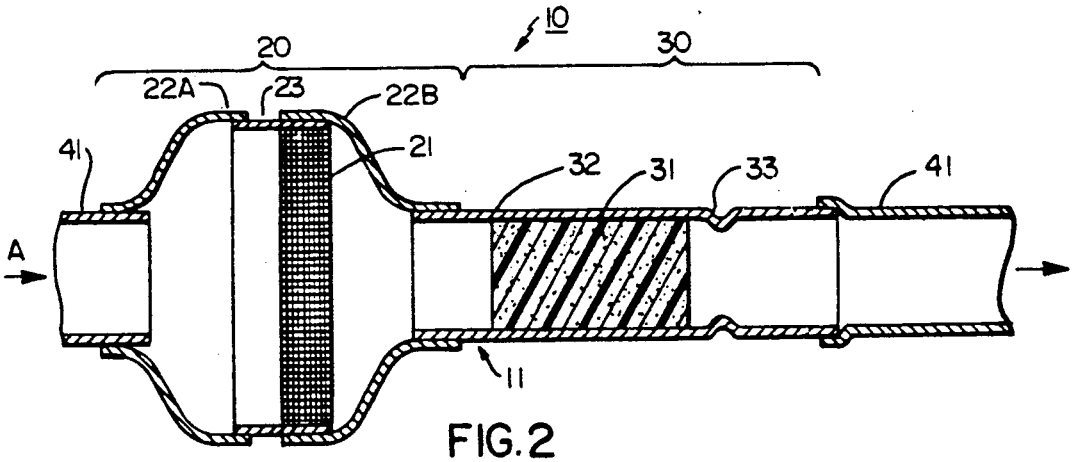
FIG. 2 is a cross sectioned elevation view of one embodiment of the present invention.

Depicted in FIG. 2, in a cross sectioned elevation view, is one embodiment of the present invention. FIG. 2 shows metering device 10 installed between two sections of feeder tubing 41 in a refrigeration system. Arrow A shows the direction of refrigerant flow through device 10. Generally cylindrical device 10 comprises filter 21 and restrictor 31 housed in casing 11 and may be divided into two sections: filter section 20 and restrictor section 30. Filter section 20 comprises bells 22A and 22B and sleeve 23 containing filter 21. Restrictor section comprises restrictor housing 32 containing restrictor 31 Restrictor 31 and restrictor housing 32 are sized for a close interference fit between the two members, both to prevent the bypassing of refrigerant around restrictor 31 and to retain restrictor 31 within restrictor housing 32. In addition, crimp 32 in restrictor housing 21 insures that restrictor 31 will not be ejected from device 1 into the system downstream under the force of the differential pressure across restrictor 31. Filter 21 and casing bell 22B are sized for a close interference fit for like reasons. Casing bell 22B also prevents downstream movement of filter 21.

Figure 3:
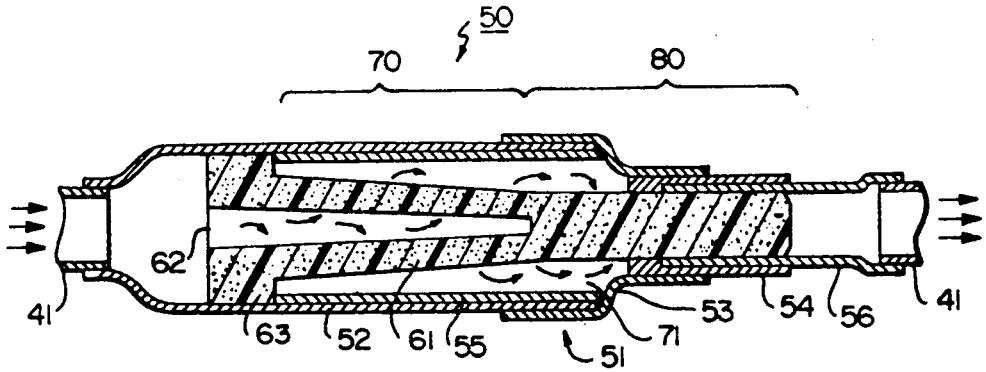
FIG. 3 is a cross sectioned elevation view of another embodiment of the present invention.

Depicted in FIG. 3, in a cross sectioned elevation view, is another embodiment of the present invention in which the functions of filtering and metering are combined in a single integral filter and restrictor. FIG. 3 shows metering device 50 installed between two sections of feeder tubing 41 in a refrigeration system. The arrows show the direction of flow of refrigerant through device 50. Generally cylindrical device 50 comprises integral filter and restrictor 61 housed in casing 51. Casing 51 comprises sleeve 52, into which is inserted spacer 55, coupling 53, bushing 54 and transition piece 56. Device 50 may be divided into filter section 70 and restrictor section 80. At its upstream or inlet end, integral filter and restrictor 61 has shoulder 63. Over the length of filter section 70, the outer diameter of integral filter and restrictor 61 is less than the inner diameter of casing 51 and gradually tapers or decreases from its upstream toward its downstream end. Annular chamber 71 is thus formed between the inner wall of casing 51 and the outer wall of integral filter and restrictor 61. Also over the length of filter section 70, integral filter and restrictor 61 has central cavity 62, whose diameter decreases from its upstream toward its downstream end so that a wall of constant thickness is formed between cavity 62 and the outer surface of the integral filter and restrictor. The diameter of the downstream end of integral filter and restrictor 61 and the diameters of bushing 54 and transition piece 56 within restrictor section 80 are sized for a close interference fit to prevent bypassing of refrigerant around integral filter and restrictor 61. Shoulder 63 bears against spacer 55 to prevent movement of integral filter and restrictor 61 within casing 51. Refrigerant entering metering device 50 flows from cavity 62 through the filter section of integral filter and restrictor 61 into and through annular chamber 71 and then through the restrictor section of integral filter and restrictor 61 before leaving the device.

All parts of the casings of both metering device 10 (FIG. 2) and metering device 50 (FIG. 3) may be fabricated of any suitable material, such as copper, and joined together by a suitable process such as brazing.

Likewise, filter 21 and restrictor 31 (FIG. 2) and integral filter and restrictor 61 (FIG. 3) may be fabricated of any suitable material. FIG. 2 shows filter 14 to be a mesh or screen, but it may be fabricated of the same material as restrictor 31. An excellent choice of materials for restrictor 31 is porous polyethylene, because it is compatible with commonly used refrigerants and lubricating oils and is relatively low in cost. A disadvantage of porous polyethylene is its low melting temperature as compared to the temperatures usually found in brazing processes. This limitation can be overcome by using heat sinks during assembly and by sizing the parts to provide adequate separation between the polyethylene members and the brazing sites. An alternative material having slightly better heat resistance is porous polytetrafluoroethylene (e.g. Teflon) but this material would also require assembly precautions. Porous copper has excellent heat resistance and performs acceptably as a restrictor but is several orders of magnitude more expensive than polyethylene.

It is desirable that the pressure drop across filter 21 (FIG. 2) and the filter section of integral filter and restrictor 61 (FIG. 3) be a minimum. If filter 21, for example, is made of the same material as restrictor 31, it should have a relatively large frontal surface and be relatively thin. Tested designs have shown that for a restrictor diameter of 0.25 inch (6 mm), the filter should have a diameter of 1 inch (25 mm) and a thickness of about 0.1 inch (2.5 mm).

Analogous to the case with capillary tubes, the magnitude of the pressure drop across a restrictor of a given diameter and made of a material having pores of a given size is a function of its length. Tests of a restrictor made of porous polyethylene having a pore size of 250 microns and having a diameter of 0.25 inch (6 mm) and a length of 0.5 inch (12.5 mm) produced pressure drops of about 47 psi (33 kPa). 0.25 inch (6 mm) is a convenient diameter for a restrictor because it fits well into the 5/16 inch (8 mm) O.D. copper tubing that is commonly used in room air conditioners. In the embodiment of the invention depicted in FIG. 2, casings of the same overall size could be fitted with restrictors having different pore sizes and lengths to make metering devices having different pressure reducing characteristics and thus suitable for use in a variety of applications. Similarly, in the embodiment of the invention depicted in FIG. 3, the pressure reducing characteristics of the device may be varied by both varying the size of the pores in the material in the integral filter and restrictor and by controlling how far the restrictor portion is inserted into the transition tube.

Tests of the present invention on a room air conditioner of moderate size have shown noise reductions of 6 dbA (from that of the same unit operating with a capillary tube as a metering device) in that portion of the total radiated noise level that is attributable to refrigerant flow through the metering device.

The above descriptions are of preferred embodiments of the present invention. One skilled in the art may appreciate that various modifications and changes could be effected without departing from the essence of the present invention. It is intended that the scope of the present invention be limited only by the following claims.

What is claimed is:

1. A refrigerant metering device comprising:

a casing having
- an upstream section,
- a downstream section and
- an inner wall; and an integral filter and restrictor fabricated of a porous material and having
- a filter section, located in said casing upstream section, and having
  - an inner cavity and
  - an outer wall,
- a restrictor section, located in said casing downstream section, and having an outer wall, and
- an annular chamber formed by and between said filter section and said restrictor section outer walls and said casing inner wall, so that refrigerant flows through said metering device by first entering said casing upstream section, then into said filter section inner cavity, then through said filter section, then through said filter section outer wall into said annular chamber, then through said restrictor section outer wall, then through said restrictor section and then exiting said casing downstream section.

* * * * *